United States Patent [19]

Phillips

[11] 4,445,285

[45] May 1, 1984

[54] SHOE SOLE

[76] Inventor: Donald W. Phillips, Chateau Perigood 1 (45 D), L Aceto St. Leon, Monte Carlo, Monaco

[21] Appl. No.: 307,250

[22] Filed: Sep. 30, 1981

[51] Int. Cl.[3] ..... A43B 13/00; A43B 13/04; A43B 19/00; A43B 13/22

[52] U.S. Cl. ..... 36/25 R; 36/72 R; 36/30 R; 36/71

[58] Field of Search ..... 36/25 R, 73, 72 R, 71.5, 36/71, 31, 28, 30 R, 32 R, 29, 19.5, 12, 14, 11.5; 12/142 Q; 2/122; 264/297; 249/157, 160, 192; 425/DIG. 55, ; D20/27

[56] References Cited

U.S. PATENT DOCUMENTS

| | | | |
|---|---|---|---|
| 2,040,001 | 5/1936 | Jones | 36/71.5 |
| 2,404,083 | 7/1946 | Murray | 36/11.5 |
| 2,492,973 | 1/1950 | Dofsen et al. | 264/297 |
| 3,008,469 | 11/1981 | Welch . | |
| 3,013,308 | 12/1961 | Armour | 264/297 |
| 3,029,531 | 4/1962 | Banks et al. | 36/25 R |
| 3,116,501 | 1/1964 | Markevitch | 36/19.5 |
| 4,183,978 | 1/1980 | Hefele | 2/122 |
| 4,246,706 | 1/1981 | Persons, Jr. | 36/73 |

FOREIGN PATENT DOCUMENTS

| | | | |
|---|---|---|---|
| 1418897 | 10/1965 | France | 36/25 R |
| 840541 | 7/1960 | United Kingdom | 36/71.5 |

*Primary Examiner*—Werner H. Schroeder
*Assistant Examiner*—Steven N. Myers
*Attorney, Agent, or Firm*—Nisson, Robbins, Dalgarn, Berliner, Capson & Wurst

[57] ABSTRACT

A shoe sole for application to the underside of a shoe includes a sole element having substantially convex upper and lower surfaces. The sole element may have a toe portion at one end thereof and the thickness of the sole element adjacent to the toe portion may increase toward the one end.

15 Claims, 8 Drawing Figures

SHOE SOLE

RELATED APPLICATION

The present invention is related to a copending United States patent application of the Applicant herein, entitled "Shoe Apparatus and Method" and identified as Ser. No. 307,249. That application was filed concurrently herewith and discloses a specific apparatus and method which may be used to apply the shoe sole of the present invention. Its teachings are hereby incorporated by reference.

BACKGROUND OF THE INVENTION

This invention relates generally to the shoe repair art and, more particularly, to an improved wearing surface portion for application to the underside of a shoe.

There have heretofore been proposed a number of types of repair soles for application to the worn underside of a shoe. Shoes have typically been "half soled" by removal of the original sole from the toe to the narrowed waist of the shoe, and sewing or gluing a new sole portion in place of the old. Leather or rubber soles of uniform thickness have generally been used for this purpose. U.S. Pat. No. 1,804,545 discloses a method for applying such soles, including beveling the underside of the new sole at a location adjacent the waist portion of the shoe. The beveled edge is tucked under a cut edge of the original sole which is similarly beveled, producing a sole of uniform thickness on the shoe. The sole of the '545 patent is applied with a waterproof adhesive material.

A specially formed repair sole for shoes is described in U.S. Pat. No. 2,016,070. It comprises a main portion of uniform thickness surrounded by a corrugated margin permitting outward extention of the repair sole to coincide with the outline of a sole to which it is applied. Although the final configuration of the repair sole thus depends upon the size of the shoe, the repair sole is not symmetric about a horizontal plane. In the fully extended condition of the corrugated margin, it is seen that the repair sole is formed with a flat adhesive coated surface for application to the original sole of the shoe being repaired. The additional thickness of the main portion is formed by providing additional material in the direction away from the shoe.

A patch for application to a worn portion of a shoe sole is disclosed in U.S. Pat. No. 2,040,001. The patch of the '001 patent is disclosed as covering only a small portion of a shoe sole. It has a flat upper surface and a curved lower surface such that the thickness of the patch tapers rather uniformly from its thickest region along one side thereof. The patch is intended to be placed with its thick region along one side edge of an old shoe sole, the tapered portions blending smoothly into the unworn portions of the original sole. The patch of the '001 patent may be either cemented or nailed in place.

However, the prior shoe repair structures described above suffer from a number of disadvantages. Primarily, shoe soles of uniform thickness fail to address the problem of highly nonuniform wear on the sole to which they are applied. In most cases, a shoe sole needing repair is worn to a greater extent at the center and the toe thereof than at other portions. A repair sole of uniform thickness simply conforms to this irregular wear pattern rather than correcting it. The only one of the discussed patents addressing itself even remotely to the problem of nonuniform wear is the '001 patent, and it is concerned only with covering an isolated portion of the shoe sole. In addition, it does not address the wear problem at the center and toe of the sole.

The repair structures of the listed patents also apparently fail to provide a suitable surface for providing a strong adhesive bond of the repair sole to the original shoe sole. In the case of the '545 patent, it is further necessary to remove the old sole and carefully prepare the shoe and the new sole. The preparation and application procedures would presumably require the labor of a skilled cobbler.

Finally, most prior shoe repair materials have been relatively expensive to produce and apply, and have often yielded less than satisfactory results.

Therefore, in many applications, it is desirable to provide an economical repair sole for shoes which can be easily applied to correct problems of undue wear in the central and toe portions of a shoe.

SUMMARY OF THE INVENTION

The present invention comprises a shoe sole for application to the underside of a shoe comprising a sole element having substantially convex upper and lower surfaces.

The sole element may be symmetric about a horizontal plane and may include: an interior portion of a first preselected thickness; a peripheral edge portion of a second preselected thickness, the second preselected thickness being less than the first; and an intermediate portion tapering from the interior portion to the peripheral edge portion to define a continuous transition therebetween.

The sole element may include a toe portion at one end thereof, and the thickness of the sole element adjacent the toe portion may increase toward the one end.

The sole element may have upper and lower surfaces which are textured and constitute mirror images of each other. The thickness of the sole element will normally vary between 0.5 and 3.5 millimeters, however, other thickness values are possible. The sole elements may be molded or otherwise formed in pairs with an integral strap connecting each pair. The sole elements in each pair may be identical in shape for application to the underside of either a right or left shoe, and may be coated on one side with a hot melt adhesive.

The substantially convex upper and lower surfaces and the thickened toe portion of the shoe sole of the present invention yield a sole which is relatively thin yet able to correct two of the most commonly encountered shoe wear problems. The thickened center of the shoe sole of the present invention fills any void which might have developed at the center of a worn sole, while providing a generous amount of a new material for future wear in that area. Any worn area at the toe of the shoe is also filled by the shoe sole of the present invention, eliminating the need to provide a wedge or other element for building up the toe for a shoe during resoling. It is believed that approximately 20 percent of the shoes currently being resoled by conventional methods require the addition of some form of material to build the toe portion of the shoe back up to its original configuration.

The pebbled texture provided on both sides of the shoe sole of the present invention enhances the adhesive properties of the sole and provides a leather-like appearance of the sole on a shoe. The provision of a hot-melt adhesive on one side of the sole also facilitates application of the shoe sole by unskilled persons.

The manufacture of the shoe soles of the present invention in pairs by a molding process both reduces the cost of the soles and eliminates any question as to whether the soles of a particular pair are of similar size. The fact that the soles are identical in shape also simplifies the manufacturing process. Until the adhesive is applied to one side or the other, the soles are interchangeable and need not be distinguished as being either right or left.

BRIEF DESCRIPTION OF THE DRAWINGS

The above and other objects of the present invention may be more fully understood from the following detailed description taken together with the accompanying drawings wherein similar reference characters refer to similar elements throughout and in which.

DESCRIPTION OF THE PREFERRED EMBODIMENTS

Figure 1:
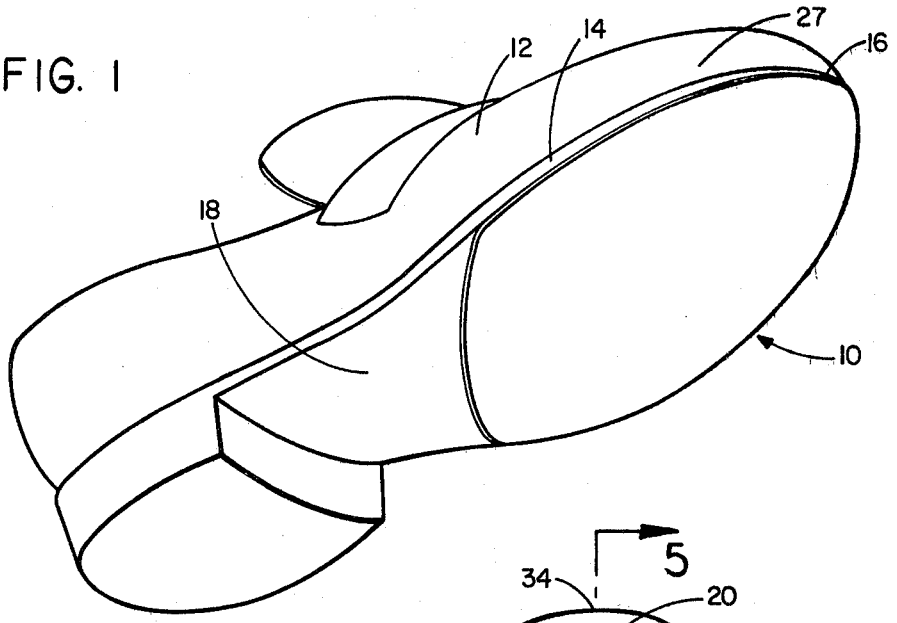
FIG. 1 is a perspective view of a shoe sole constructed in accordance with the present invention, as applied to a shoe.

Referring now to the drawings, there is illustrated at FIG. 1 a shoe sole 10 constructed in accordance with the present invention and attached to a shoe 12. The shoe sole 10 is attached to an underside or sole portion 14 of the shoe 12 to cover the areas of the sole portion which are subject to wear. This area includes the entire width of the sole portion 14 from a toe 16 to the beginning of a narrowed waist portion 18.

Figure 2:
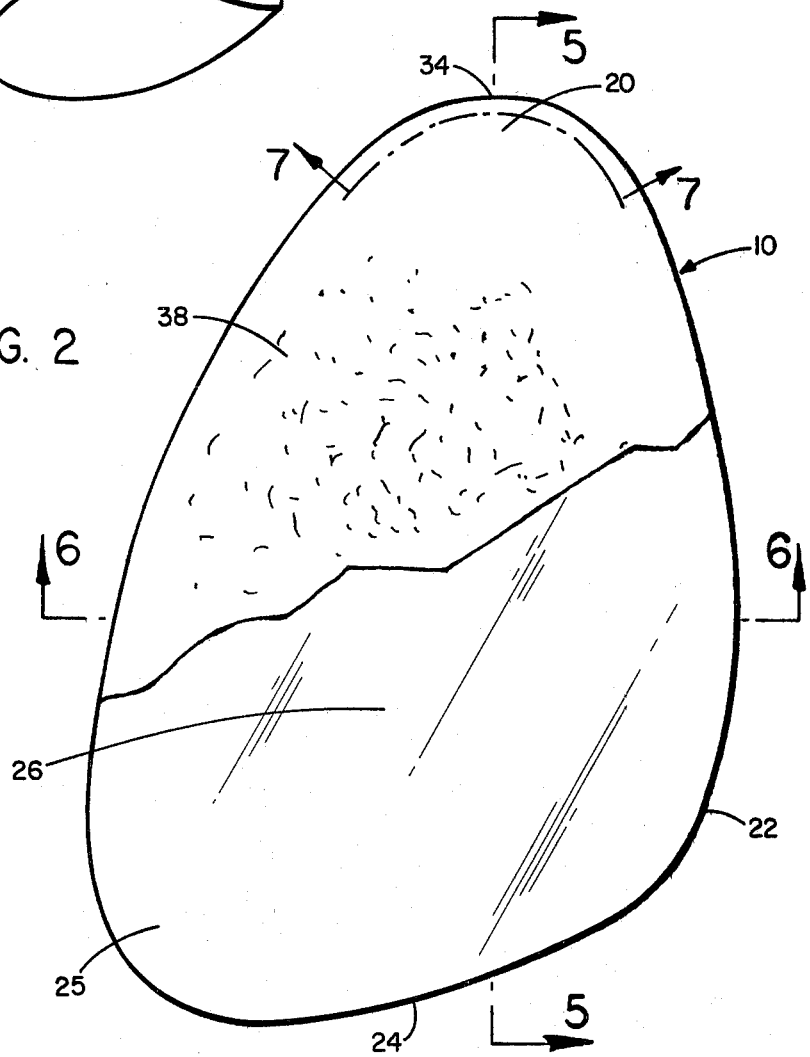
FIG. 2 is a top plane view, partially broken away, of a shoe sole constructed in accordance with the present invention.
Figure 3:
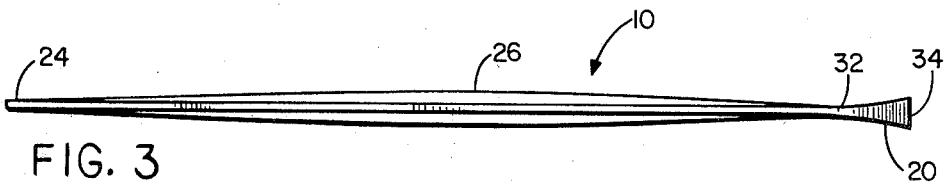
FIG. 3 is a side elevational view of the shoe sole of FIG. 2.
Figure 4:
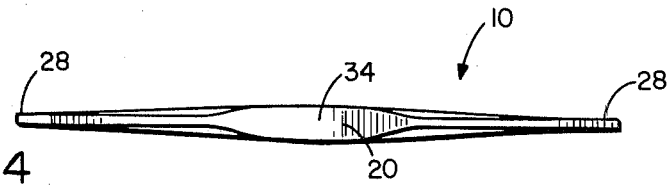
FIG. 4 is a front elevational view of the shoe sole of FIG. 2.

The general shape of the shoe sole 10 is shown in FIG. 2. The sole 10 widens in a rearward direction from a somewhat blunted toe portion 20 to an area 22 corresponding generally to the ball of a wearer's foot. From the area 22, the sole 10 again narrows to a rear portion 24 which coincides with the beginning of the waist portion 18 of the shoe to which the sole is applied. The sole 10 is uniquely shaped for application to either a right or a left shoe. In the orientation of FIG. 2, the shoe sole 10 will cover the desired areas of a right-hand shoe, and if turned over it will cover the critical wear areas of a left-hand shoe. In practice, however, the shoe sole 10 preferably includes an adhesive layer 25 preapplied to one or the other of its surfaces. With the adhesive layer 25 applied as shown in FIG. 2, the sole 10 is usable exclusively on a right hand shoe of the appropriate size.

Figure 5:
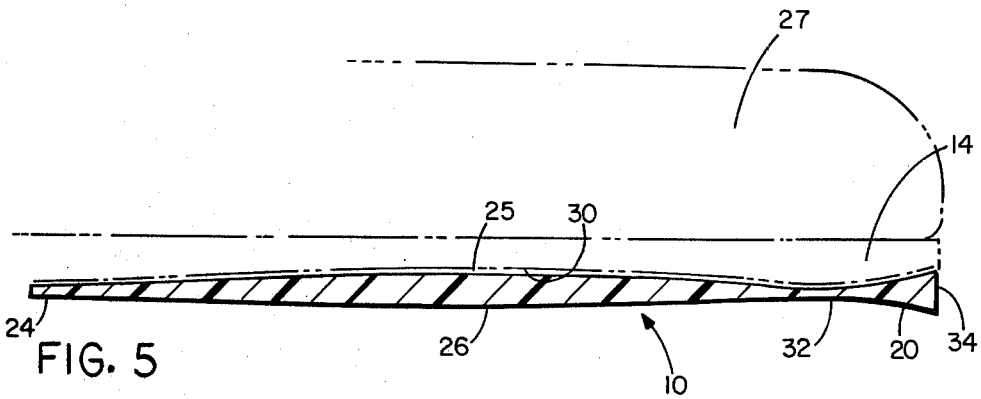
FIG. 5 is a vertical sectional view taken along the line 5—5 of FIG. 2, showing a portion of the underside of a worn shoe in phantom lines.
Figure 6:
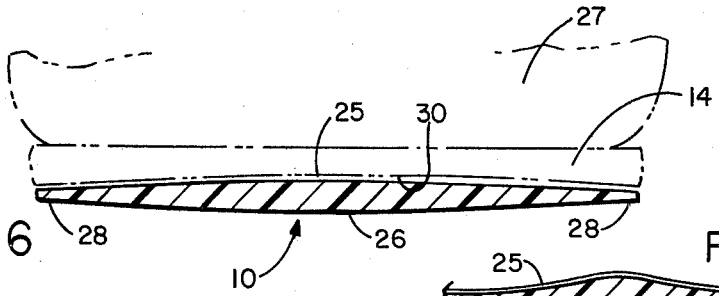
FIG. 6 is a vertical section view taken along the line 6—6 of FIG. 2, showing a portion of the underside of a worn shoe in phantom lines.

The unique thickness profile of the shoe sole 10 can be seen from FIGS. 3 through 7. FIGS. 5 and 6 illustrate the shoe sole 10 in conjunction with the sole portion 14 and a shoe upper 27 of the shoe to which the sole 10 is applied. The sole 10 tapers in thickness from a relatively thick interior location 26 to thinner portions at a pair of side edges 28 and at the rear portion 24. As shown in FIGS. 5 and 6, relatively thick interior location 26 coincides with a commonly worn area 30 at essentially the center of the sole portion 14. The thickness of the shoe sole 10 at the location 26 serves in part to replenish the worn material of the sole portion 14 and return the underside of the shoe 12 to essentially its original configuration. However, in many cases the thickness of the interior location 26 of the shoe sole 10 may be sufficient to yield a total sole thickness somewhat greater than the original unworn thickness of the sole portion 14. At a minimum, the convex configuration of the shoe sole 10 will usually recreate the slightly convex shape of the underside of many unworn shoes.

Figure 7:
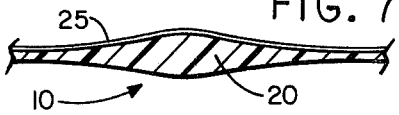
FIG. 7 is a fragmentary vertical sectional view taken along the line 7—7 of FIG. 2.

As seen best in FIGS. 5 and 7, the one edge at which the thickness of the sole is not reduced is the edge adjacent the toe portion 20. While the thickness of the sole tapers down from the location 26 in the direction of the toe portion 20, and in fact reaches a thickness approximately equal to that of the edges 28 at a point 32 between the interior location 26 and the toe portion, the thickness of the sole 10 again increases adjacent the toe portion 20 in a forward direction. The thickness of the sole at a front end 34 thereof may reach a value approximately equal to the thickness of the sole at the interior location 26.

As seen in FIG. 5, the thickened toe portion 20 of the shoe sole 10 coincides with a common wear area at the toe 16 of the shoe 12. The toe portion 20 thus corrects for inordinate shoe wear at the toe 16, restoring the underside of the shoe to at least its original thickness at that location. The increased thickness of the toe portion 20 is particularly advantageous in avoiding the high labor and material costs of repairing shoes with worn toes. There is no need to insert special wedges or other materials to build up the worn toe area of the shoe in the manner required in conventional shoe repair.

The shoe sole 10 may also be applied to the undersides of new shoes for the purpose of increasing the useful life of the shoes. When applied to the underside of a new shoe, the sole 10 receives the bulk of the wear and the original sole of the shoe is left undamaged. With the high prices and relatively poor wearing characteristics of many modern shoes, the additional wear provided by application of the shoe sole 10 can be highly desirable.

Figure 8:
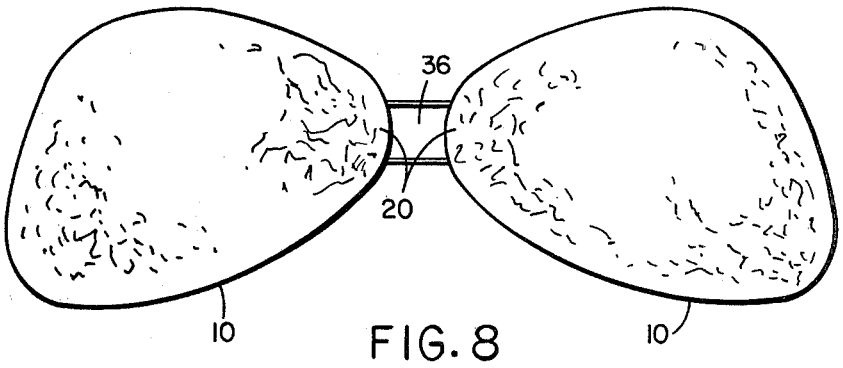
FIG. 8 is a top plan view of a pair of shoe soles constructed in accordance with the present invention as they are released from the mold.

As shown in FIG. 8, the shoe soles 10 are preferably molded in pairs from a homogeneous synthetic composition, and are connected together at the toe portions thereof by a thin molded strap 36 formed integrally therewith. When laid out in the manner of FIG. 8, one of the shoe soles appears oriented for application to a right-hand shoe while the other appears oriented for application to a left-hand shoe. As described above, each of the shoe soles is usable on either a right-hand or a left-hand shoe, depending upon the side to which the adhesive coating is applied.

The strap 36 can also serve as a form of tag bearing information to indicate the size of shoe for which the soles 10 are designed. Before use, the strap 36 can be cut from the soles 10 with a pair of scissors.

The shoe soles 10 may be formed of either thermosetting or thermoplastic material. The material preferably comprises a thermo-setting butadiene-styrene composition. When either compression molded or injected molded to the shape of the shoe sole 10, such compositions have been found to exhibit a hardness of 90 on the Shore Schlorescope "A" Scale. They can also withstand temperatures up to 200° Celsius without losing their advantageous physical properties, permitting them to be heated to the temperatures required to fully liquefy many "hot melt" adhesives. Soles of this composition exhibit highly desirable wear properties while at the same time being somewhat slippery in relation to the ground. Slipperiness is generally desirable in shoe soles, the heels or top lifts of the shoes being relied upon for traction.

Alternatively, the shoe soles 10 may be made of injection molded polyurethane or other suitable material.

The adhesive of the coating 25 is preferably a suitable hot melt adhesive which does not become tacky until it is melted by heating to temperatures on the order of 180° Celsius. The coating 25 and the shoe sole are thus easily handled prior to melting. Suitable commercially available adhesives can be used for these purposes. Upon melting the adhesive coating and pressing the sole tightly against the underside of the shoe for approximately 10 seconds, a strong bond can be formed between the sole and the shoe.

After the sole 10 has been applied to the shoe 12, a portion of the sole 10 may extend outwardly beyond the underside of the shoe. This excess portion of the sole 10 may then be trimmed away with a pair of shears or other suitable device, and the edge of the sole 10 and the shoe 12 may be colored with shoe wax to provide a uniform appearance.

Both the upper and lower surfaces of the shoe sole 10 are preferably provided with a pebbled texture, as shown at 38 in FIG. 2. This texture provides a good foundation for adhesion of the coating 25. The adhesive coating is thus received within the irregularities of the texture and becomes tightly bonded thereto. The pebbled texture of the uncoated surface of the shoe sole 10 gives the sole a leather-like appearance on the shoe.

From the above, it can be seen that there has been provided an inexpensive shoe sole which can be easily applied to the underside of either a new or a worn shoe to substantially increase the useful life thereof.

The appended claims are intended to cover all variations and adaptations falling within the true scope and spirit of the present invention.

What is claimed is:

1. A wear portion for use in repairing a shoe having a toe portion, a waist portion and an existing sole with a ground engaging surface, comprising:

wear means having substantially convex upper and lower surfaces;

the wear means extending in an operative position thereof from the toe portion to a point at the beginning of the waist portion of the shoe; and the upper surface of the wear means being attachable to the ground engaging surface of the shoe in said operative position so that the lower surface engages the ground.

2. The wear portion recited in claim 1 wherein the wear means includes a toe region at one end thereof and the thickness of the wear means adjacent to the toe region increases toward the one end.

3. The wear portion recited in claims 1 or 2 wherein the upper and lower surfaces are mirror images of each other.

4. The wear portion recited in claim 3 wherein the upper and lower surfaces are both textured.

5. The wear portion recited in claim 1 wherein the wear means is between 0.5 and 3.5 millimeters thick.

6. The wear portion recited in claim 1 which comprises a pair of said wear means formed of a homogeneous material and joined by a strap of the homogenous material formed integrally therewith.

7. The wear portion recited in claim 6 wherein the wear means are identical in shape for application to the underside of either a right or a left shoe.

8. The wear portion recited in claim 6 wherein the strap is severable and provides visual indication of the size of shoe for which the wear portion is designed.

9. The wear portion recited in claim 1 which further comprises a layer of hot melt adhesive on one of the substantially convex surfaces.

10. The wear portion recited in claim 9 wherein the adhesive layer extends substantially continuously over said one of the convex surfaces.

11. The wear portion recited in claim 9 wherein the wear means is formed of a homogenous thermo-setting material.

12. The wear portion recited in claim 11 wherein the thermo-setting material is a butadiene-styrene composition.

13. A wear portion for use in repairing shoes having a toe portion, a waist portion and an existing sole with a ground engaging surface, comprising:

wear means symmetric about a horizontal plane, the wear means comprising:

an interior portion of a first preselected thickness;

a peripheral edge portion of a second preselected thickness, the second preselected thickness being less than the first preselected thickness; and an intermediate portion tapering from the interior portion to the peripheral edge portion to define a continuous transition therebetween;

the wear means extending in an operative position thereof from the toe portion to a point at the beginning of the waist portion of the shoe; and the wear means being attachable to the ground engaging surface of the shoe in said operative position so that the wear means engages the ground.

14. The wear portion recited in claim 13 wherein the wear means includes a toe region at one end thereof, and the thickness of the wear means adjacent the toe region increases toward the one end.

15. The wear portion recited in claim 14 wherein the thickness of the wear means at the one end is substantially the same as the first preselected thickness.

* * * * *